US011322295B2

(12) United States Patent
Araki

(10) Patent No.: US 11,322,295 B2
(45) Date of Patent: May 3, 2022

(54) COIL COMPONENT

(71) Applicant: Murata Manufacturing Co., Ltd., Kyoto-fu (JP)

(72) Inventor: Kenichi Araki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 647 days.

(21) Appl. No.: 15/878,044

(22) Filed: Jan. 23, 2018

(65) Prior Publication Data

US 2018/0233272 A1 Aug. 16, 2018

(30) Foreign Application Priority Data

Feb. 16, 2017 (JP) ..... JP2017-027132

(51) Int. Cl.
*H01F 27/29* (2006.01)
*H01F 17/04* (2006.01)
(Continued)

(52) U.S. Cl.
CPC ..... *H01F 27/29* (2013.01); *H01F 17/045* (2013.01); *H01F 27/022* (2013.01);
(Continued)

(58) Field of Classification Search
CPC ..... H01F 17/045
See application file for complete search history.

(56) References Cited

U.S. PATENT DOCUMENTS 6,831,824 B1 * 12/2004 Devoe ..... H01G 2/065 361/303
6,917,510 B1 * 7/2005 Prymak ..... H01G 2/065 361/309
(Continued)

FOREIGN PATENT DOCUMENTS

CN 104979082 A 10/2015
JP S542142 U 1/1979
(Continued)

OTHER PUBLICATIONS

An Office Action; "Notification of Reasons for Refusal," mailed by the Japanese Patent Office dated Feb. 26, 2019, which corresponds to Japanese Patent Application No. 2017-027132 and is related to U.S. Appl. No. 15/878,044; with English language translation.
(Continued)

*Primary Examiner* — Elvin G Enad
*Assistant Examiner* — Malcolm Barnes
(74) *Attorney, Agent, or Firm* — Studebaker & Brackett PC

(57) ABSTRACT

A coil component includes a magnetic body portion that includes metallic particles and a resin material, a coil conductor that is embedded in the magnetic body portion, and a first outer electrode and a second outer electrode each of which is electrically connected to the coil conductor. At least a portion of an outer layer of the magnetic body portion forms an electrically conductive layer that includes a second metallic material having a specific resistance lower than a specific resistance of a first metallic material forming the metallic particles. The electrically conductive layer includes a first electrically conductive layer that is electrically connected to the first outer electrode and a second electrically conductive layer that is electrically connected to the second outer electrode. The first electrically conductive layer and the second electrically conductive layer are electrically isolated from each other.

16 Claims, 4 Drawing Sheets

(51) Int. Cl.

| | |
|---|---|
| ***H01F 41/02*** | (2006.01) |
| ***H01F 27/255*** | (2006.01) |
| ***H01F 27/32*** | (2006.01) |
| ***H01F 27/02*** | (2006.01) |
| ***H01F 41/00*** | (2006.01) |

(52) U.S. Cl.
CPC ..... *H01F 27/255* (2013.01); *H01F 27/327* (2013.01); *H01F 41/005* (2013.01); *H01F 41/02* (2013.01); *H01F 41/0246* (2013.01); *H01F 2017/048* (2013.01)

(56) References Cited

U.S. PATENT DOCUMENTS

| | | | | |
|---|---|---|---|---|
| 7,248,458 | B2 * | 7/2007 | Mruz | H01G 2/065 361/303 |
| 2003/0099085 | A1 * | 5/2003 | Duva | H01G 2/12 361/311 |
| 2010/0039749 | A1 * | 2/2010 | Ritter | H01G 4/005 361/301.4 |
| 2012/0327554 | A1 * | 12/2012 | Moalemi | H01G 4/228 361/321.1 |
| 2013/0020913 | A1 * | 1/2013 | Shirakawa | H01G 4/30 310/364 |
| 2013/0222106 | A1 * | 8/2013 | Saito | H01C 7/008 338/22 R |
| 2013/0255071 | A1 * | 10/2013 | Muneuchi | H01F 41/02 29/605 |
| 2014/0286814 | A1 * | 9/2014 | Kotani | C22C 38/00 419/30 |

FOREIGN PATENT DOCUMENTS

| | | | |
|---|---|---|---|
| JP | H07-14715 | A | 1/1995 |
| JP | 2010-186909 | A | 8/2010 |
| JP | 4961445 | B2 * | 6/2012 |
| JP | 2015-204337 | A | 11/2015 |
| JP | 2016-111280 | A | 6/2016 |
| JP | 2016-162764 | A | 9/2016 |
| WO | 2012070336 | A1 | 5/2012 |
| WO | 2015/115318 | A1 | 8/2015 |

OTHER PUBLICATIONS

An Office Action; "Notification of Reasons for Refusal," Mailed by the Japanese Patent Office dated Aug. 6, 2019, which corresponds to Japanese Patent Application No. 2017-027132 and is related to U.S. Appl. No. 15/878,044; with English language translation.

An Office Action issued by the State Intellectual Property Office of the People's Republic of China dated Mar. 20, 2020, which corresponds to Chinese Patent Application No. 201810149814.X and is related to U.S. Appl. No. 15/878,044. with English language translation.

* cited by examiner

COIL COMPONENT

CROSS-REFERENCE TO RELATED APPLICATION

This application claims benefit of priority to Japanese Patent Application No. 2017-027132, filed Feb. 16, 2017, the entire content of which is incorporated herein by reference.

BACKGROUND

Technical Field

The present disclosure relates to a coil component, and more particularly to a coil component that includes a magnetic body portion, a coil conductor embedded in the magnetic body portion, and an outer electrode provided on the outer side of the magnetic body portion.

Background Art

As a coil component in which a coil conductor is embedded in a magnetic body portion, there is known a coil component that includes a magnetic body portion formed by using a composite material containing metallic particles and a resin material (International Publication No. 2015/115318). In a coil component, such as that described above, that includes a magnetic body portion formed by using a composite material containing metallic particles and a resin material, outer electrodes are generally formed by applying a silver paste containing a thermosetting resin to the magnetic body portion by dip coating. However, such a method has a problem in that the manufacturing costs are high because a thick film is formed by using silver. In addition, there is another problem in that, since the resin is present between the silver powder, the resistance of each of the outer electrodes is large, so that the efficiency of a product is decreased.

In order to address these problems, forming the outer electrodes by performing plating directly on the magnetic body portion may be considered. In the case where the outer electrodes are formed by plating in this manner, particularly in the case where the outer electrodes are formed by barrel plating, it is necessary to electrically connect the outer electrodes to each other and energize the outer electrodes at an early stage immediately after the plating has been started. If the energization is delayed, power supply from media may sometimes be hindered as a result of, for example, adhesion of impurities to a surface of the magnetic body portion, and outer electrodes having desired electrical characteristics may sometimes not be obtained. In addition, it is likely that variations in an energized state between chips will occur, and variations in a plating thickness between the chips may also occur.

SUMMARY

Accordingly, the present disclosure provides a coil component in which a coil conductor is embedded in a magnetic body portion including metallic particles and a resin material, and the coil conductor is capable of reducing variations in thickness and electrical characteristics between outer electrodes and being manufactured at low cost. As a result of extensive studies conducted in order to solve the above problems, the inventor of the present disclosure discovered that, in a process of forming outer electrodes on a magnetic body portion, electrical connection between the outer electrodes can be obtained in a short time after a plating process has been started by electrically connecting the outer electrodes to each other not only by a coil conductor but also by a surface of the magnetic body portion, so that outer electrodes having favorable electrical characteristics can be obtained, and accordingly, the present disclosure has been made.

According to a first preferred embodiment of the present disclosure, a coil component is provided that includes a magnetic body portion that includes metallic particles and a resin material, coil conductor that is embedded in the magnetic body portion, and a first outer electrode and a second outer electrode each of which is electrically connected to the coil conductor. At least a portion of an outer layer of the magnetic body portion forms an electrically conductive layer that includes a second metallic material having a specific resistance lower than a specific resistance of a first metallic material forming the metallic particles. The electrically conductive layer includes a first electrically conductive layer that is electrically connected to the first outer electrode and a second electrically conductive layer that is electrically connected to the second outer electrode, with the first electrically conductive layer and the second electrically conductive layer being electrically isolated from each other.

According to a second preferred embodiment of the present disclosure, a method is provided for manufacturing a coil component that includes a magnetic body portion including metallic particles and a resin material, a coil conductor embedded in the magnetic body portion, and a first outer electrode and a second outer electrode each electrically connected to the coil conductor and in which at least a portion of an outer layer of the magnetic body portion forms an electrically conductive layer including a second metallic material. The second metallic material has a specific resistance lower than a specific resistance of a first metallic material forming the metallic particles. The electrically conductive layer includes a first electrically conductive layer that is electrically connected to the first outer electrode and a second electrically conductive layer that is electrically connected to the second outer electrode and electrically isolated from the first electrically conductive layer. The method includes performing displacement plating using the second metallic material on a surface of the magnetic body portion, in which the coil conductor is embedded, and coating, with an insulating film, the surface of the magnetic body portion excluding portions of the surface on which the first outer electrode and the second outer electrode are formed. The method further includes forming the first outer electrode and the second outer electrode on exposed portions of the magnetic body portion, which is coated with the insulating film, by performing plating on the magnetic body portion, and electrically isolating the first outer electrode and the second outer electrode from each other by forming a groove in the surface of the magnetic body portion.

According to the present disclosure, a coil component includes a magnetic body portion including metallic particles and a resin material, a coil conductor embedded in the magnetic body portion, and a pair of outer electrodes each electrically connected to the coil conductor. A metallic material having a specific resistance lower than that of a metallic material forming the above-mentioned metallic particles is provided in or on the outer layer of the magnetic body portion, and thus, a coil component including outer electrodes that are formed by plating and in which variations in their thicknesses are suppressed can be provided.

Other features, elements, characteristics and advantages of the present disclosure will become more apparent from the following detailed description of preferred embodiments of the present disclosure with reference to the attached drawings.

DESCRIPTION OF EMBODIMENTS

Figure 1:
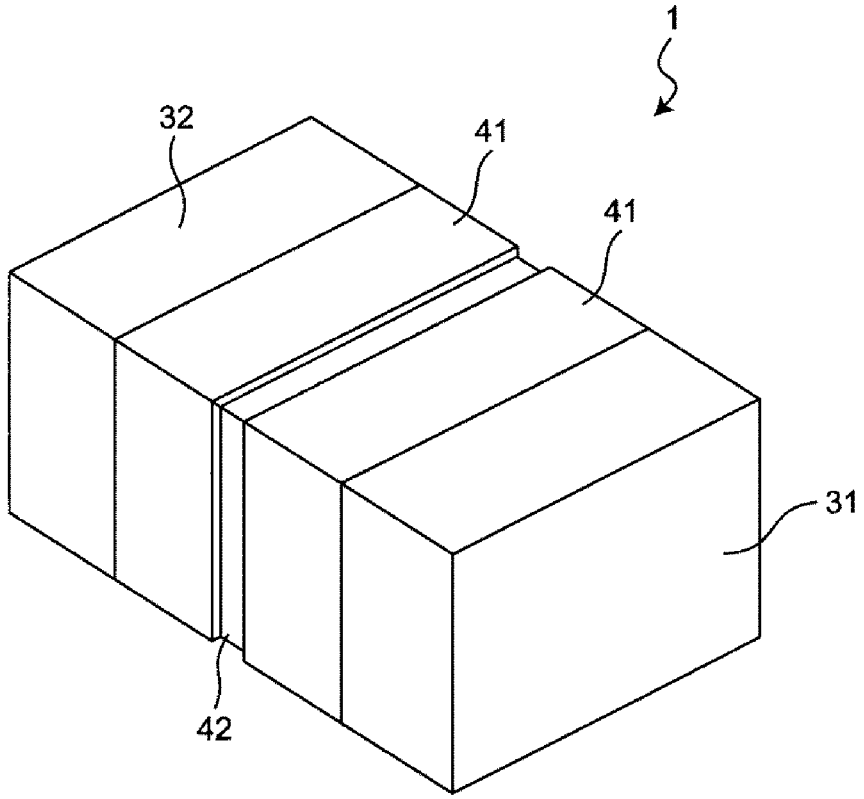
FIG. 1 is a perspective view schematically illustrating a coil component according to an embodiment of the present disclosure.

A coil component according to an embodiment of the present disclosure will be described in detail below with reference to the drawings. Note that the shapes, arrangements, and the like of the coil component according to the embodiment and each component are not limited to those illustrated as examples in the drawings.

Figure 2:
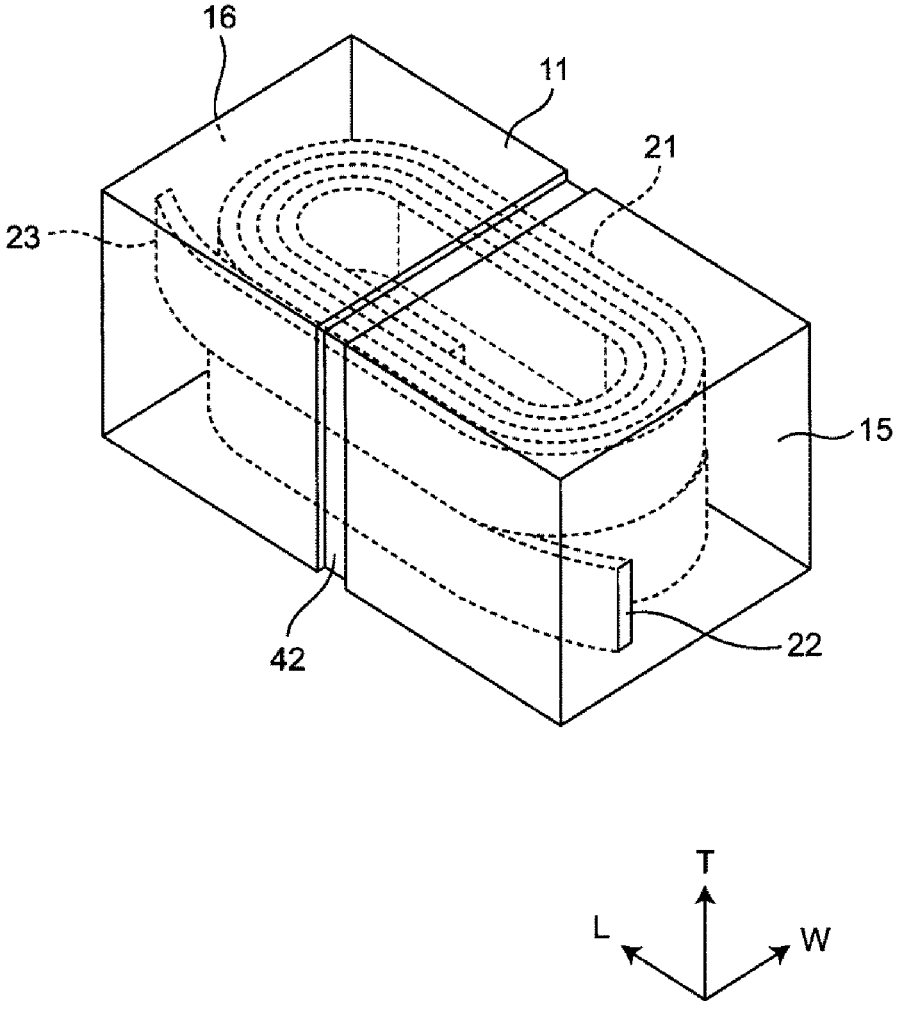
FIG. 2 is a perspective view of a magnetic body portion that is included in the coil component illustrated in FIG. 1 and in which a coil conductor is embedded.
Figure 3:
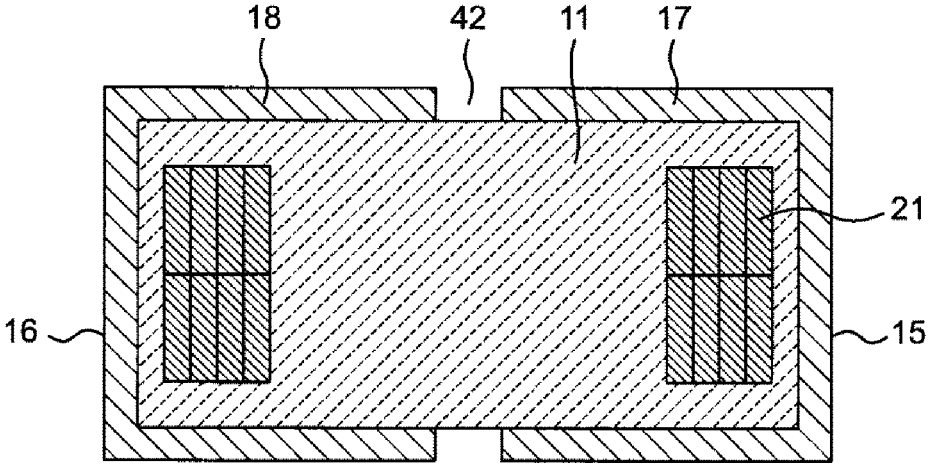
FIG. 3 is a sectional view schematically illustrating a cut surface of the magnetic body portion, in which the coil conductor illustrated in FIG. 2 is embedded, the cut surface being parallel to an LT plane.

FIG. 1 schematically illustrates a perspective view of a coil component 1 according to the present embodiment, and FIG. 2 schematically illustrates a perspective view of a magnetic body portion 11 that is included in the coil component 1 and in which a coil conductor 21 is embedded. FIG. 3 is a sectional view schematically illustrating a cut surface of the magnetic body portion 11, in which the coil conductor 21 is embedded, the cut surface being parallel to an LT plane.

As illustrated in FIG. 1 to FIG. 3, the coil component 1 according to the present embodiment has a substantially rectangular parallelepiped shape. The coil component 1 generally includes the magnetic body portion 11, the coil conductor 21 embedded in the magnetic body portion 11, a first outer electrode 31 and a second outer electrode 32. In addition, a groove 42 is formed in side surfaces of the coil component 1 so as to surround the coil component 1, and an insulating film 41 is provided on portions of a surface of the coil component 1, the portions being located between the groove 42 and the first outer electrode 31 and between the groove 42 and the second outer electrode 32. The magnetic body portion 11 has a substantially rectangular parallelepiped shape and has a first end surface 15, a second end surface 16 facing the first end surface 15, and the four side surfaces located between the first and second end surfaces 15 and 16. The magnetic body portion 11 has the groove 42 extending along the four side surfaces so as to surround the magnetic body portion 11. A first electrically conductive layer 17 and a second electrically conductive layer 18 are present on the outer layer of the magnetic body portion 11 and are electrically isolated from each other by the groove 42. The first outer electrode 31 and the second outer electrode 32 are located on the first end surface 15 and the second end surface 16, respectively, and extend therefrom to portions of the four side surfaces. A first end 22 of the coil conductor 21 is electrically connected to the first outer electrode 31, and a second end 23 of the coil conductor 21 is electrically connected to the second outer electrode 32.

The above-mentioned magnetic body portion 11 includes metallic particles and a resin material. It is preferable that the magnetic body portion 11 be made of a composite material containing metallic particles and a resin material.

The above-mentioned resin material is not particularly limited, and examples of the resin material include organic materials such as an epoxy resin, a phenolic resin, a polyester resin, a polyimide resin, and a polyolefin resin. Only one type of resin material may be used, or two or more types of resin materials may be used.

The above-mentioned metallic particles are made of a first metallic material. The above-mentioned first metallic material is not particularly limited, and examples of the first metallic material include iron, cobalt, nickel, gadolinium, and an alloy containing one or two or more of these materials. It is preferable that the first metallic material be iron or an iron alloy. The iron alloy is not particularly limited, and examples of the iron alloy include Fe—Si, Fe—Si—Cr, and Fe—Si—Al. Only one type of first metallic material may be used, or two or more types of first metallic materials may be used.

The above-mentioned metallic particles may be crystalline metal (or alloy) particles or may be amorphous metal (or alloy) particles. The average particle diameter of the above-mentioned metallic particles may preferably be about 5 μm or more, and more preferably about 10 μm or more. Setting the average particle diameter of the metallic particles to about 5 μm or more, and more particularly to about 10 μm or more improves the handleability of the metallic particles. In addition, the average particle diameter of the metallic particles may preferably be about 200 μm or less, more preferably about 100 μm or less, and further preferably about 80 μm or less. By setting the average particle diameter of the metallic particles to about 200 μm or less, and more particularly to about 100 μm or less, the filling percentage of the metallic particles can be increased, and magnetic characteristics of the magnetic body portion 11 are improved. In addition, the groove 42 can be made shallow. Here, the term "average particle diameter" refers to an average particle diameter D50 (particle diameter corresponding to a cumulative percentage of about 50% on a volumetric basis). The average particle diameter D50 can be measured by using, for example, a dynamic light scattering particle size analyzer (manufactured by Nikkiso Co., Ltd., UPA). In one aspect of the present disclosure, the average particle diameter of the metallic particles may preferably be about 5 μm or more and about 200 μm or less (i.e., from about 5 μm to about 200 μm), more preferably about 10 μm or more and about 100 μm or less (i.e., from about 10 μm to about 100 μm), and further preferably about 10 μm or more and about 80 μm or less (i.e., from about 10 μm to about 80 μm).

In one aspect of the present disclosure, the metallic particles may include at least two types (e.g., two types, three types, or four types) of metallic particles having different average particle diameters. By using metallic particles having different average particle diameters, the magnetic characteristics of the magnetic body portion 11 may be further improved, and the adhesive strength of each of the first and second outer electrodes 31 and 32, which are formed by plating, may be improved. In one aspect of the present disclosure, by using, as the metallic particles, iron or iron alloy particles and particles having an average particle diameter smaller than that of the iron or iron alloy particles, the magnetic characteristics of the magnetic body portion 11 can be improved.

The surface of each of the above-mentioned metallic particles may be coated with an insulating coating film. By coating the surface of each of the metallic particles with an insulating coating film, the specific resistance of the interior of the magnetic body portion 11 can be increased.

Although not particularly limited, the thickness of the above-mentioned insulating coating film may preferably be about 5 nm or more and about 1 μm or less (i.e., from about 5 nm to about 1 μm), more preferably about 10 nm or more and about 100 nm or less (i.e., from about 10 nm to about 100 nm), and further preferably about 20 nm or more and about 100 nm or less (i.e., from about 20 nm to about 100 nm). By increasing the thickness of the insulating coating film, the specific resistance of the magnetic body portion 11 can be further increased. By reducing the thickness of the insulating coating film, the amount of the metallic material in the magnetic body portion 11 can be increased, so that the magnetic characteristics of the magnetic body portion 11 may be improved, and a reduction in the size of the magnetic body portion 11 may easily be facilitated.

In one aspect of the present disclosure, the thickness of the insulating coating film may be about 40 nm or more. By setting the thickness of the insulating coating film to about 40 nm or more, the specific resistance of the magnetic body portion 11 can be further increased. In another aspect of the present disclosure, the thickness of the insulating coating film may be less than about 40 nm. Setting the thickness of the insulating coating film to less than about 40 nm facilitates precipitation of a different metal onto the surfaces of the metallic particles through, for example, a plating process.

In one aspect of the present disclosure, the above-mentioned metallic particles may include particles A that have an average thickness of less than about 40 nm and that are coated with an insulating coating film and particles B that have an average thickness of about 40 nm or more and that are coated with an insulating coating film. It is preferable that the ratio (A/B) of the particles A to the particles B be about 0.1 or more and about 1.0 or less (i.e., from about 0.1 to about 1.0), and more preferably about 0.3 or more and about 0.5 or less (i.e., from about 0.3 to about 0.5). As described above, by using a plurality of types of metallic particles that are coated with insulating coating films of different thicknesses, voltage-resistance characteristics of the magnetic body portion 11 and precipitation characteristics of plating can be controlled.

The content of the above-mentioned metallic particles in the magnetic body portion 11 may preferably be about 50% by volume or more, more preferably about 60% by volume or more, and further preferably about 70% by volume or more with respect to the entire magnetic body portion 11. By setting the content of the metallic material to be within the above range, magnetic characteristics of the coil component 1 according to the present disclosure may be improved. In addition, the content of the metallic particles may preferably be about 95% by volume or less, more preferably about 90% by volume or less, further preferably about 87% by volume or less, and further more preferably about 85% by volume or less with respect to the entire magnetic body portion 11. By setting the content of the metallic particles to be within the above range, the specific resistance of the magnetic body portion 11 can be further increased. In one aspect of the present disclosure, the content of the metallic particles may preferably be about 50% by volume or more and about 95% by volume or less (i.e., from about 50% by volume to about 95% by volume), more preferably about 60% by volume or more and about 90% by volume or less (i.e., from about 60% by volume to about 90% by volume), further preferably about 70% by volume or more and about 87% by volume or less (i.e., from about 70% by volume to about 87% by volume), and further more preferably about 70% by volume or more and about 85% by volume or less (i.e., from about 70% by volume to about 85% by volume) with respect to the entire magnetic body portion 11.

At least a portion of the outer layer of the magnetic body portion 11 may be an electrically conductive layer that includes a second metallic material having a specific resistance lower than that of the first metallic material, which forms the above-mentioned metallic particles. More specifically, the outer layer of the magnetic body portion 11 may include the first electrically conductive layer 17 and the second electrically conductive layer 18 that are isolated from each other by the groove 42. As described below, when forming the first outer electrode 31 and the second outer electrode 32 by plating, the first electrically conductive layer 17 and the second electrically conductive layer 18 that have not yet been isolated from each other by the groove 42 function as an electrically conductive path between the first outer electrode 31 and the second outer electrode 32 and suppress variations in thickness and electrical characteristics between the first outer electrode 31 and the second outer electrode 32. In addition, by using a material having a high thermal conductivity as the second metallic material, heat dissipation from the surface of the coil component 1 can be increased, and the heat-dissipation performance can be improved.

The above-mentioned second metallic material is a metallic material having a specific resistance lower than that of the above-mentioned first metallic material. The second metallic material may preferably be a metal that causes a substitution reaction with the first metallic material. The second metallic material is not particularly limited, and examples of the second metallic material include copper and aluminum. It is preferable that the second metallic material be copper. Only one type of second metallic material may be used, or two or more types of second metallic materials may be used.

Although not particularly limited, in the magnetic body portion 11, it is preferable that the thickness of each of the first and second electrically conductive layers 17 and 18 be approximately equal to the average particle diameter of the above-mentioned metallic particles, which may be, for example, about 5 nm or more and about 1 μm or less (i.e., from about 5 nm to about 1 μm), more preferably about 10 nm or more and about 100 nm or less (i.e., from about 10 nm to about 100 nm), and further preferably about 20 nm or more and about 100 nm or less (i.e., from about 20 nm to about 100 nm). In a preferred aspect of the present disclosure, the first metallic material is iron or an iron alloy, and the second metallic material is copper.

The magnetic body portion 11 has the groove 42 extending along the four side surfaces so as to surround the magnetic body portion 11. The shape, depth, and the like of the groove 42 are not limited as long as the groove 42 can electrically isolate the first electrically conductive layer 17 and the second electrically conductive layer 18 from each other. The depth of the groove 42 may preferably be about 200 μm or less, more preferably about 100 μm or less, and further preferably about 50 μm or more.

In one aspect of the present disclosure, a portion of the surface of the magnetic body portion 11, the portion being adjacent to the coil conductor 21, may be removed. By removing a portion of the magnetic body portion 11 in the region adjacent to the coil conductor 21, a gap between the magnetic body portion 11 and the coil conductor 21 is increased, and media may easily penetrate when barrel plating is performed, so that the precipitation speed of plating is improved. The coil conductor 21 is formed by winding a conductor wire including an electrically conductive material into a substantially coil shape.

The above-mentioned electrically conductive material is not particularly limited, and examples of the electrically conductive material include gold, silver, copper, palladium, and nickel. It is preferable that the electrically conductive material be copper. Only one type of electrically conductive material may be used, or two or more types of electrically conductive materials may be used.

In the present embodiment, as illustrated in FIG. 2, the coil conductor 21 is formed by being wound in a two-tiered, substantially spiral pattern such that the first and second ends 22 and 23 are located on the outer side of the coil conductor 21. In other words, the coil conductor 21 is formed by winding a substantially flat conductor wire in an outside-to-outside manner (i.e., alpha winding). The first end 22 of the coil conductor 21 is exposed at the first end surface 15 of the magnetic body portion 11, and the second end 23 of the coil conductor 21 is exposed at the second end surface 16 of the magnetic body portion 11.

In one aspect of the present disclosure, the above-mentioned conductor wire forming the coil conductor 21 may be coated with an insulating material. By coating the conductor wire forming the coil conductor 21 with an insulating material, the coil conductor 21 and the magnetic body portion 11 can be insulated from each other with higher certainty. In this case, a coating film made of the insulating material is also present around the end portions of the coil conductor 21. Therefore, when the first outer electrode 31 and the second outer electrode 32 are formed by plating, the first outer electrode 31 and the second outer electrode 32 are in a state of not being connected to each other by the coil conductor 21 until the plating grows over the coating film made of the insulating material. In this state, if the first outer electrode 31 and the second outer electrode 32 are not electrically connected to each other by any other means, there may be a case where a problem will occur in that only a plating film that has made contact with media grows. However, in the manufacturing method according to the present disclosure, which will be described below, the first outer electrode 31 and the second outer electrode 32 are brought into a state of being electrically connected to each other by an electrically conductive layer that is present on the outer layer of the magnetic body portion 11, and thus, the above-mentioned problem will not occur.

In a preferred aspect of the present disclosure, in the case where the conductor wire forming the coil conductor 21 is coated with an insulating material, end portions of extended portions of the coil conductor 21, the extended portions being to be connected to the first outer electrode 31 and the second outer electrode 32, are exposed. All of the remaining portions of the conductor wire are coated with the insulating material. In other words, the coil conductor 21 includes exposed portions located at the opposite ends thereof and a coated portion located between the exposed portions. By coating the conductor wire forming the coil conductor 21 with the insulating material, the coil conductor 21 and the magnetic body portion 11 may be insulated from each other with higher certainty, and a plating process may be further easily performed by exposing the end portions of the coil conductor 21. In addition, the resistance of a connecting portion in which the coil conductor 21 and the first outer electrode 31 are connected to each other and the resistance of a connecting portion in which the coil conductor 21 and the second outer electrode 32 are connected to each other can be further decreased. The above-mentioned insulating material is not particularly limited, and examples of the insulating material include a polyurethane resin, a polyester resin, an epoxy resin, and polyamide-imide resin.

In the present embodiment, the first and second ends 22 and 23 of the coil conductor 21 are obliquely cut. In other words, the angle of the cross section of each of the first and second ends 22 and 23 of the coil conductor 21 with respect to the central axis of the conductor wire forming the coil conductor 21 is smaller than 90 degrees. Note that the above-mentioned "angle of the cross section of each of the first and second ends 22 and 23 of the coil conductor 21 with respect to the central axis of the conductor wire forming the coil conductor 21" refers to the minimum angle formed by the above-mentioned cross section and the above-mentioned central axis. By setting the above-mentioned angle to be small, the cross-sectional area of each of the first and second ends 22 and 23 of the coil conductor 21 is increased, and plating formation may be facilitated, so that incomplete plating can be suppressed. In addition, contact surfaces of the coil conductor 21 and the first and second outer electrodes 31 and 32 are increased, and thus, the resistance at each of the connecting portions can be decreased.

Note that the coil conductor according to the present disclosure is not limited to the present embodiment and is not particularly limited as long as the coil conductor can be used in a coil component. For example, it is not necessary to obliquely cut the ends of the coil conductor as in the above-described embodiment, and the ends may be cut such that the above-mentioned angle becomes a right angle. In addition, in the above-described embodiment, although the coil conductor 21 is disposed such that the central axis of the coil conductor 21 extends horizontally to the first end surface 15 and the second end surface 16, the coil conductor 21 may be disposed such that the central axis of the coil conductor 21 extends perpendicularly.

The first outer electrode 31 is provided so as to extend from the first end surface 15 to portions of the four side surfaces, and the second outer electrode 32 is provided so as to extend from the second end surface 16 to portions of the four side surfaces. Each of the first and second outer electrodes 31 and 32 may have a single layer or may be multilayered. It is preferable that the first outer electrode 31 and the second outer electrode 32 be formed by plating. In the case where each of the first and second outer electrodes 31 and 32 is multilayered, it is preferable that the lowermost layer thereof be a plating layer.

Each of the first and second outer electrodes 31 and 32 may be formed of an electrically conductive material and may preferably be formed of one or more types of metal materials selected from the group consisting of Au, Ag, Pd, Ni, and Cu. In a preferred aspect of the present disclosure, in the case where each outer electrode is multilayered, the lowermost layer thereof is a copper plating layer, and a nickel plating layer and a tin plating layer are present on the copper plating layer. Although not particularly limited, the thickness of each of the first and second outer electrodes 31 and 32 may be, for example, about 1 μm or more and about 50 μm or less (i.e., from about 1 μm to about 50 μm), and preferably about 5 μm or more and about 20 μm or less (i.e., from about 5 μm or more and about 20 μm).

In the present embodiment, the insulating film 41 is provided on the outer surface of the magnetic body portion 11 excluding portions of the outer surface on which the first outer electrode 31 and the second outer electrode 32 are provided and a portion of the outer surface in which the groove 42 is formed. For example, the insulating film 41 is made of a resin material, such as an acrylic resin, an epoxy resin, or a polyimide, that has a high electrical insulating property. Note that, in the present disclosure, the insulating film is not essential and may not be provided.

A method for manufacturing the coil component 1 will now be described.

First, the magnetic body portion 11 (hereinafter also referred to as a main body) in which the coil conductor 21 is embedded is manufactured. A plurality of coil conductors 21 are arranged in a metal mold. Next, a sheet made of a composite material containing metallic particles and a resin material is placed onto these coil conductors 21, and then primary press forming is performed. By performing the primary press forming, at least portions of the coil conductors 21 are embedded in the above-mentioned sheet, and the interior of each of the coil conductors 21 is filled with the composite material.

Subsequently, the sheet, in which the coil conductors 21 have been embedded as a result of performing the primary press forming, is removed from the metal mold. Then, another sheet is placed onto a surface at which the coil conductors 21 are exposed, and secondary press forming is performed. As a result, an aggregate coil substrate including a plurality of main bodies is obtained. The above-mentioned two sheets are integrated with each other through the secondary press forming, so that the magnetic body portion 11 of the coil component 1 is formed.

After that, the aggregate coil substrate obtained through the secondary press forming is divided into the individual main bodies. The first end 22 and the second end 23 of each of the coil conductors 21 are respectively exposed at the first end surface 15 and the second end surface 16 of a corresponding one of the obtained main bodies, the first end surface 15 and the second end surface 16 facing each other.

The aggregate coil substrate can be divided into the individual main bodies by using one of a dicing blade, various lasers, a dicer, various edged tools, and a metal mold. In a preferred aspect of the present disclosure, barrel polishing is performed on the cross section of each of the main bodies.

A method for manufacturing the main body of the coil component 1 according to the present disclosure has been described above. However, the method for manufacturing the main body is not limited to the above-described method and is not particularly limited as long as the method enables the coil conductor to be embedded in the magnetic body portion. Other examples of the method include a method for forming a block body by sequentially repeating printing lamination by, for example, screen printing using a coil conductor paste and a paste containing metallic particles and then singulating and firing the block body into fired bodies and a method for embedding a coil conductor into a core formed by molding a composite material.

Next, the second metallic material is provided in or on the outer layer of the magnetic body portion 11, in which the coil conductor 21 has been embedded. The second metallic material can be provided in or on the outer layer of the magnetic body portion 11 by replacing a metal forming the metallic particles, which are present in or on the outer layer of the magnetic body portion 11, the metal being typically iron, with the second metallic material or by precipitating the second metallic material onto the metallic particles. More specifically, the second metallic material is precipitated onto the metallic particles of the outer layer of the magnetic body portion 11 by performing displacement plating on one of the main bodies obtained as described above. As a result, an electrically conductive layer is formed on the outer layer of the magnetic body portion 11. Note that, regarding the electrically conductive layer, it is not necessary to completely coat the outer layer of the magnetic body portion 11 with the second metallic material, and the first end surface 15 and the second end surface 16 may be electrically connected to each other as a result of the second metallic material being present in a scattered manner in or on the outer layer of the magnetic body portion 11. The electrically conductive layer is not necessarily formed throughout the entire outer layer of the magnetic body portion 11 as long as the electrically conductive layer is formed so as to be capable of electrically connecting the first outer electrode 31 and the second outer electrode 32 to each other when the first outer electrode 31 and the second outer electrode 32 are formed. For example, the electrically conductive layer may be formed on only one, two, or three side surfaces of the magnetic body portion 11 or may be formed on a portion of each of the side surfaces.

Next, an insulating film is formed on the entire surface of the main body obtained as described above. The insulating film can be formed by spraying, dipping, or the like.

Subsequently, the first outer electrode 31 and the second outer electrode 32 are respectively formed on the first end surface 15, at which the first end 22 of the coil conductor 21 is exposed, and the second end surface 16, at which the second end 23 of the coil conductor 21 are exposed. Portions of the insulating layer coating the main body, which has been obtained as described above, the portions being located at positions at which the first outer electrode 31 and the second outer electrode 32 are to be formed, are removed. It is preferable that the portions of the insulating layer be removed by laser radiation. Then, the first outer electrode 31 and the second outer electrode 32 are formed by plating, preferably electrolytic plating. Although the plating method is not particularly limited, it is preferable that barrel plating be performed. The first end 22 and the second end 23 of the coil conductor 21 are electrically connected to the first outer electrode 31 and the second outer electrode 32, respectively.

Finally, the groove 42 is formed in the side surfaces of the coil component 1 so as to surround the coil component 1 in order to electrically isolate the first outer electrode 31 and the second outer electrode 32 from each other. The groove 42 is formed so as to have a depth deep enough to remove the electrically conductive layer of the magnetic body portion 11. The electrically conductive layer is divided into the first electrically conductive layer 17 and the second electrically conductive layer 18 by the groove 42. As a result, the coil component 1 according to the present disclosure is manufactured.

The method for forming the above-described groove 42 is not particularly limited, and examples of the method include physical treatments, such as laser radiation, dicer cutting, and sandblasting, and a chemical treatment, such as etching. It is preferable that the groove 42 be formed by dicer cutting.

In the above-described method, when the first outer electrode 31 and the second outer electrode 32 are formed by plating, a plating layer precipitated on the first end surface 15 and a plating layer precipitated on the second end surface 16 are electrically connected to each other, immediately after a plating process has been started, by the electrically conductive layer formed on the outer layer of the magnetic body portion 11 and including the second metallic material. Therefore, the first outer electrode 31 and the second outer electrode 32 can be formed without variations.

Accordingly, the present disclosure also provides a method for manufacturing a coil component that includes a magnetic body portion including metallic particles and a resin material, a coil conductor embedded in the magnetic body portion, and a first outer electrode and a second outer electrode each electrically connected to the coil conductor and in which at least a portion of an outer layer of the magnetic body portion forms an electrically conductive layer including a second metallic material. The second metallic material has a specific resistance lower than a specific resistance of a first metallic material forming the metallic particles, and the electrically conductive layer includes a first electrically conductive layer that is electrically connected to the first outer electrode and a second electrically conductive layer that is electrically connected to the second outer electrode and electrically isolated from the first electrically conductive layer. The method includes performing displacement plating using the second metallic material on a surface of the magnetic body portion, in which the coil conductor is embedded, and coating, with an insulating film, the surface of the magnetic body portion excluding portions of the surface on which the first outer electrode and the second outer electrode are formed. The method further includes forming the first outer electrode and the second outer electrode on exposed portions of the magnetic body portion, which is coated with the insulating film, by performing plating on the magnetic body portion, and electrically isolating the first outer electrode and the second outer electrode from each other by forming a groove in the surface of the magnetic body portion.

Figure 4:
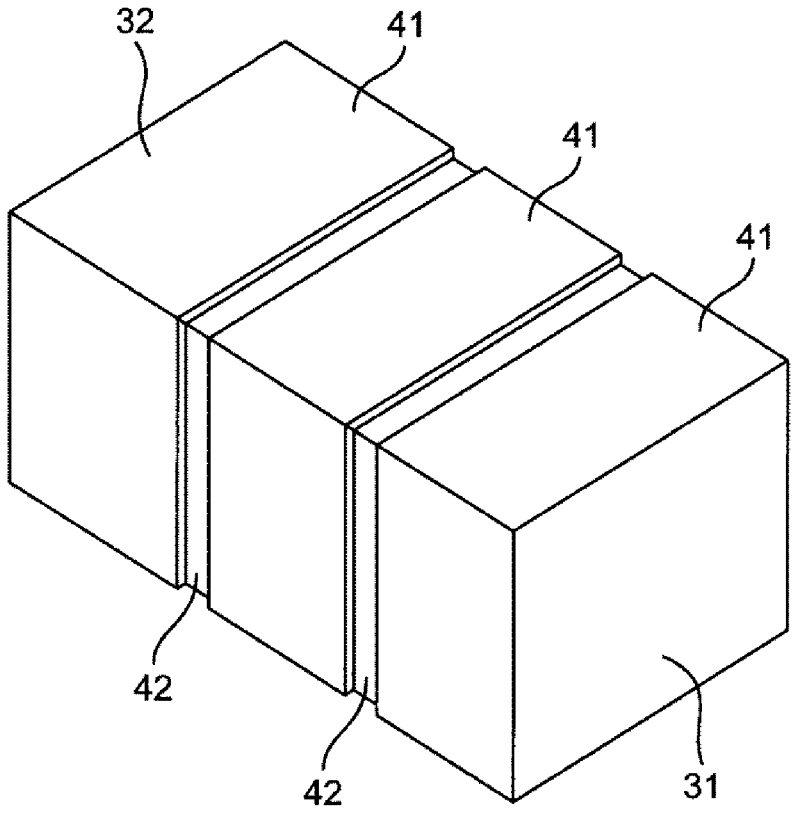
FIG. 4 is a perspective view schematically illustrating a coil component according to another embodiment of the present disclosure.

Although the coil component according to the present disclosure and the method for manufacturing the coil component have been described above, the present disclosure is not limited to the above-described embodiment, and design changes can be made within the gist of the present disclosure. For example, in another aspect of the present disclosure, two grooves may be formed as illustrated in FIG. 4.

In addition, metallic particles each of which does not have an insulating coating film may be present at the positions at which the first outer electrode and the second outer electrode of the magnetic body portion are formed. The metallic particles may be applied by, for example, dip coating immediately before the first outer electrode and the second outer electrode are formed or may be provided in or on an end surface of the magnetic body portion when the magnetic body portion is formed. In other words, the metallic particles each of which is not coated with an insulating coating film may be present in or on surface portions of the magnetic body portion on which the first outer electrode and the second outer electrode are present. As a result, the current density at each of the positions at which the first outer electrode and the second outer electrode are formed increases, and the plating time can be reduced.

EXAMPLES

Example 1

A composite sheet including Fe—Si—Cr based metallic particles (having an average particle diameter of 50 μm) as metallic particles and an epoxy resin as a resin material was prepared. Meanwhile, α-winding coil conductors each of which is made of copper and coated with a polyurethane resin, which serves as an insulating material, (a coil conductor formed by winding a flat conductor wire in two tiers in an outside-to-outside manner) were prepared.

Next, the above-mentioned plurality of α-winding coil conductors were arranged on a metal mold, and the above-mentioned composite sheet was placed thereon from above. Then, pressing was performed for 30 minutes under conditions of a pressure of 5 MPa and a temperature of 150° C.

Subsequently, the composite sheet that has been integrated with the coil conductors was removed from the metal mold, and another composite sheet was placed on a surface at which the coil conductors were exposed. Then, pressing was performed for 30 minutes under conditions of a pressure of 5 MPa and a temperature of 150° C., and as a result, an aggregate coil substrate in which the plurality of coil conductors were embedded was manufactured.

After that, the above-mentioned aggregate coil substrate was divided into individual main bodies by using a dicing blade, and barrel polishing was performed on the main bodies. Ends of the coil conductors were exposed at opposing side surfaces (end surfaces) of the obtained main bodies.

Then, the main bodies were immersed in a barrel plating bath for 30 minutes, so that copper was precipitated on the Fe—Si—Cr based metallic particles of magnetic body portions by displacement plating. After that, an insulating film was formed on the entire surface of each of the main bodies by spray coating.

Next, portions of the insulating film were removed by being irradiated with YVO4 laser, the portions being located at positions at which outer electrodes were to be formed. After that, exposed portions of the magnetic body portions were plated with copper by electrolytic barrel plating (a current of 15 A, a temperature of 55° C., and a plating time of 50 minutes), so that the outer electrodes were formed.

Subsequently, a groove was formed in each of the main bodies by using a dicing blade in order to cut an electrically conductive path on a surface of the main body, the electrically conductive path being located between the corresponding outer electrodes, and as a result, the coil components of Example 1 was manufactured.

Comparative Example 1

Coil components of Comparative Example 1 were manufactured in a manner similar to Example 1, which has been described above, except that a process of precipitating copper onto magnetic body portions by displacement plating was not performed and that the plating time was set to 90 minutes in order to cause each outer electrode to have a thickness approximately equal to that in Example 1.

(Evaluation)

The thickness of each of the outer electrodes of the manufactured coil components of Example 1 and the thickness of each of the outer electrodes of the manufactured coil components of Comparative Example 1 were measured by using a fluorescent X-ray film thickness gauge. The average (Ave.) and standard deviation (σ) of the thicknesses of the outer electrodes of the coil components were determined (n=30).

TABLE 1

| | Example 1 | Comparative Example 1 |
|---|---|---|
| Plating Time (min) | 50 | 90 |
| Ave. (μm) | 12 | 11 |
| σ (μm) | 1.5 | 3.1 |

As is clear from the above results, it was confirmed that the outer electrodes of the coil components of Example 1 had smaller variations in thickness than the outer electrodes of the coil components of Comparative Example 1. It was also confirmed that, in the coil components of Example 1, the time taken to form the outer electrodes having thicknesses approximately equal to one another was shorter than that in the coil components of Comparative Example 1, that is, the film deposition rate in Example 1 was higher than that in Comparative Example 1.

The coil component according to the present disclosure may be used in a wide variety of applications as, for example, an inductor.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a magnetic body portion that includes a resin material and metallic particles made of a first metallic material, at least a portion of an outer layer of the magnetic body portion forming an electrically conductive layer that includes a second metallic material having a specific resistance lower than a specific resistance of the first metallic material, the electrically conductive layer being formed by displacing a first metal in the first metallic material with a second metal of the second metallic material, the magnetic body portion includes a first end surface, a second end surface, and four side surfaces;

a coil conductor that is embedded in the magnetic body portion;

a groove is formed in each of the four side surfaces of the magnetic body portion to surround the coil component; and a first outer electrode and a second outer electrode each of which is electrically connected to the coil conductor, wherein the electrically conductive layer includes a first electrically conductive layer that is electrically connected to the first outer electrode and a second electrically conductive layer that is electrically connected to the second outer electrode, the first electrically conductive layer and the second electrically conductive layer being electrically isolated from each other by the groove, the second metallic material is formed by displacing a first metal of the first metallic material with a second metal of the second metallic material, and the first electrically conductive layer and the second electrically conductive layer are each coated with an insulating film except for a region in which the first outer electrode and the second outer electrode are provided.

2. The coil component according to claim 1, wherein each of the first outer electrode and the second outer electrode is a plating layer.

3. The coil component according to claim 1, wherein the groove has a depth of about 200 μm or less.

4. The coil component according to claim 1, wherein the metallic particles have an average particle diameter of about 200 μm or less.

5. The coil component according to claim 1, wherein the metallic particles include particles coated with insulating coating films having an average thickness of less than about 40 nm and particles coated with insulating coating films having an average thickness of about 40 nm or more.

6. The coil component according to claim 1, wherein the first metallic material is iron or an iron alloy.

7. The coil component according to claim 1, wherein the second metallic material is copper.

8. The coil component according to claim 1, wherein the coil conductor is coated with an insulating material.

9. The coil component according to claim 1, wherein metallic particles each of which is not coated with an insulating coating film are present in or on surface portions of the magnetic body portion on which the first outer electrode and the second outer electrode are present.

10. The coil component according to claim 2, wherein, in each of the first electrically conductive layer and the second electrically conductive layer, a region in which the first outer electrode and the second outer electrode are not present is coated with an insulating film.

11. The coil component according to claim 2, wherein the metallic particles have an average particle diameter of about 200 μm or less.

12. The coil component according to claim 2, wherein the metallic particles include particles coated with insulating coating films having an average thickness of less than about 40 nm and particles coated with insulating coating films having an average thickness of about 40 nm or more.

13. The coil component according to claim 2, wherein the first metallic material is iron or an iron alloy.

14. The coil component according to claim 2, wherein the second metallic material is copper.

15. The coil component according to claim 2, wherein the coil conductor is coated with an insulating material.

16. A method for manufacturing a coil component comprising:

preparing a coil conductor embedded in a magnetic body portion including a resin material and metallic particles made of a first metallic material;

displacement plating a surface of the magnetic body portion using a second metallic material;

coating, with an insulating film, the surface of the magnetic body portion excluding portions of the surface on which a first outer electrode and a second outer electrode are to be formed;

plating the magnetic body portion with the insulating film to form the first outer electrode and the second outer electrode on exposed portions of the magnetic body portion from the insulating film; and forming a groove in the surface of the magnetic body portion to electrically isolate the first outer electrode and the second outer electrode from each other.

* * * * *